United States Patent [19]

Narita et al.

[11] 4,195,823

[45] Apr. 1, 1980

[54] METHOD OF AND AN APPARATUS FOR AGITATING A BATH OF MELTED METAL FOR TREATING THE SAME

[75] Inventors: Kiichi Narita, Kobe; Takasuke Mori, Ashiya; Takamichi Ito, Kobe, all of Japan

[73] Assignee: Kobe Steel, Ltd., Kobe, Japan

[21] Appl. No.: 919,687

[22] Filed: Jun. 27, 1978

Related U.S. Application Data

[60] Continuation of Ser. No. 578,894, May 19, 1975, abandoned, which is a division of Ser. No. 368,283, Jun. 8, 1973, abandoned.

[51] Int. Cl.[2] ..... C21C 7/00; C21B 7/16

[52] U.S. Cl. ..... 266/233; 75/53; 75/61; 266/217

[58] Field of Search ..... 266/233, 217; 75/53, 75/61

[56] References Cited

U.S. PATENT DOCUMENTS

| | | | |
|---|---|---|---|
| 3,573,895 | 4/1971 | Ostberg | 75/61 |
| 3,802,872 | 4/1974 | Ostberg | 75/53 |
| 3,887,172 | 6/1975 | Funck | 266/217 |

*Primary Examiner*—P. D. Rosenberg

*Attorney, Agent, or Firm*—Oblon, Fisher, Spivak, McClelland & Maier

[57] ABSTRACT

A method of agitating a bath of melted metal for treating the same by blowing gas into a one piece columnar body of such melted metal disposed in the bath to cause the apparent specific gravity of the columnar body to be reduced and to thereby be hydrostatically lifted, and returning the lifted portion of the melted metal to the bath by pouring the same with a splashing effect onto the free surface of the bath, in a manner to continuously change the pouring position on the free surface of the bath, thereby causing improved agitation of the bath, and especially improved contact and mixing of the melted metal and a treating agent generally floating on the free surface of the bath.

10 Claims, 12 Drawing Figures

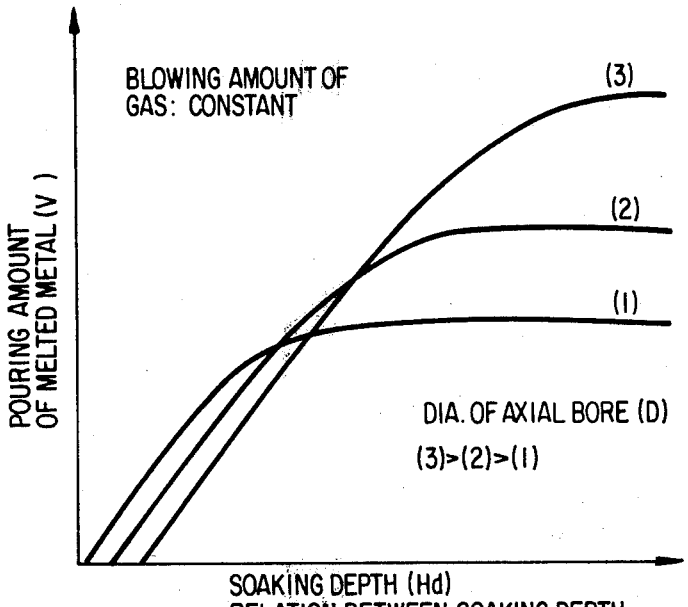
FIG. 11 RELATION BETWEEN SOAKING DEPTH OF AXIAL BORE AND POURING AMOUNT OF MELTED METAL
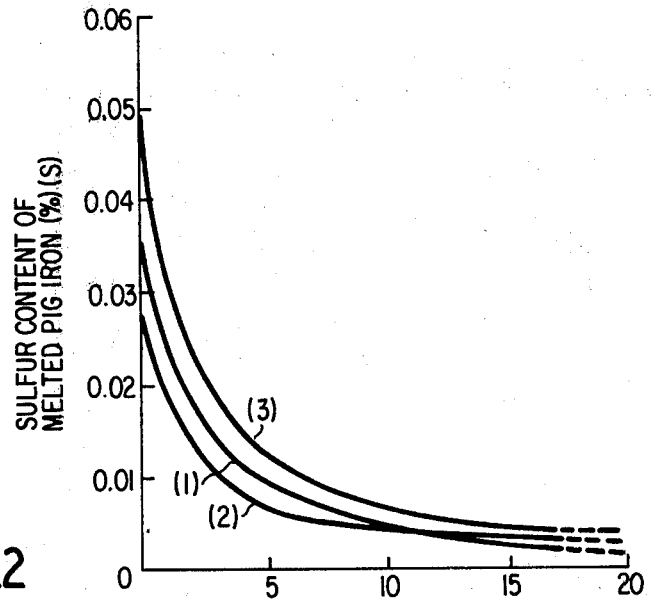
FIG. 12 CHANGE OF SULFUR CONTENT IN A DESULFURIZING COMPOUND

METHOD OF AND AN APPARATUS FOR AGITATING A BATH OF MELTED METAL FOR TREATING THE SAME

This is a continuation, of application Ser. No. 578,894, filed May 19, 1975, which is a division of application Ser. No. 368,283, filed June 8, 1973, both now abandoned.

BACKGROUND OF THE INVENTION

1. Field of the Invention

This invention relates generally to a method and an apparatus for agitating a bath of melted metal to treat the same physically, chemically or metallurgically, such as, for example, by degasifying, desulphurizing or alloying.

2. Description of the Prior Art

In the art of treating a metal, such as for example, an iron, a nonferrous metal or an alloy, in the form of a melted bath thereof, with or without supplying additives thereto, by degasifying desulphurizing, alloying, and the like, it is essential that the bath of melted metal is agitated as intensely and uniformly as possible. As a method of agitating a bath of melted metal, it is conventionally known to use mechanical agitating means, such as an impeller or a stirrer. However, such mechanical agitating means are generally bound with much of the difficulties caused by the high temperature to which mechanically movable means are usually subject, whereby the cost of the equipment is quite high, while the same usually enjoys a relatively short life span.

Another conventional method of agitating a bath of melted metal is to blow a gas or gases into the bath. The gas blown into the bath forms a number of bubbles which rise through the bath to the surface thereof, and these bubbles agitate the body of the bath while rising therethrough, and particularly they agitate the surface region of the bath as they penetrate the surface layer. In most cases of treating a bath of melted metal, the surface layer of the bath is formed with a treating agent such as a desulphurizer, and therefore, the agitation of the surface layer by bubbles penetrating therethrough is effective to cause the melted metal and the treating agent to contact and mix with each other. In this method, however, it takes much time to have all parts of the body of the bath contacted and mixed with the treating agent floating on the surface region of the melted metal, and the efficiency of treatment is recognized as being relatively low.

As still another conventional method of agitating a bath of melted metal, it is known to generate a natural circulation of the bath by blowing a gas or gases therein. When a gas is blown into a bath of melted metal to form a number of small bubbles therein, a portion of the bath, including the bubbles, shows a decreased apparent specific gravity so long as the bubbles remain therein, and therefore, if the gas is continuously blown into a particular portion of the bath, it is possible to form a portion in the bath where the apparent specific gravity is constantly being reduced as compared with the surrounding portions of the bath. Thus, for example, by defining a columnar region in the bath by means of a tubular member 4, as shown in FIG. 1, and blowing a gas into the columnar region at a lower portion thereof through a gas inlet passage 7 having openings 9 to the columnar region, the apparent specific gravity of the columnar region is reduced as compared with that of the surrounding region 2, whereby a natural circulation of the bath into the columnar region through openings in the bottom of the tubular member 4, upward within the tubular member and out through side openings 6 in the upper region of the tubular member for mixing with the surrounding bath portion 2 is generated. However, in this conventional method of generating a natural circulation in the bath, the agitation is still not sufficient, especially when the melted metal is to be treated by being contacted and mixed with a treating agent floated on the surface of the bath, because in this method, the flow of the melted metal generated by the natural circulation is always poured on the same portion of the floated layer of the treating agent, and therefore, all portions of the treating agent forming the floated layer are not effectively brought into contact with the melted metal, thereby resulting in a treating operation of poor efficiency and one requiring much time.

SUMMARY OF THE INVENTION

Therefore, it is a primary object of this invention to provide an improved method of agitating a bath of melted metal for treating the same, whereby especially mixing of the body of the bath of melted metal with a treating agent floated at the free surface of the bath is effecitvely accomplished.

The above-mentioned object is accomplished, according to this invention, by a method of agitating a bath of melted metal for treating the same by defining a columnar body of the melted metal hydrostatically communicating with the bath at the lower end portion thereof, with this columnar body being adapted to have a reduced apparent specific gravity by being mixed with gas as compared with a remaining body of the bath, and pouring the melted metal forming the uppermost region of the columnar body onto the free surface of the bath from the upper side thereof, characterized by continuously changing the position of the pouring of the melted metal on the free surface of the bath by relatively moving the melted metal pouring point with respect to the free surface.

According to this method, the melted metal forming a lower portion of the body of the bath is raised by way of the columnar body due to a hydrostatic force caused by a difference of the specific gravity of the columnar body and of the remaining body of the bath, and is returned to the remaining body of the bath in a manner of being poured onto the free surface thereof, from the upper side thereof and continuously on different portions of the free surface. Therefore, according to this invention, not only is the generation of a thoroughly circulating flow of the melted metal in the bath achieved, but also an intense agitation at the boundary region between the bath of melted metal and the layer of the floated treating agent over all portions of the layer, especially in a manner of forcibly introducing all portions of the treating agent into the body of the bath of melted metal.

By pouring the melted metal equally on all portions of the layer of treating agent being floated on the free surface of the bath in a continuously changing pattern, the agitation of the bath is more intensified, whereby the contacting and mixing of the melted metal and the treating agent, as well as the overall agitation of the bath necessary for uniformizing the quality of the bath, are very much improved.

Also according to this invention, the method of agitating a bath of melted metal for treating the same is accomplished by an apparatus comprising a columnar member adapted to be substantially vertically disposed in the bath and having at least one axial bore extending therethrough open at its upper end to at least one transverse bore and open at its lower end to the surrounding bath, and the columnar member being further provided with a gas passage opening to the inside of the axial bore at a portion adjacent the lower end thereof. The columnar member may be provided with a plurality of axial bores, and furthermore, the number of the transverse bores may be equal to that of the axial bores so that an axial bore is in communication with a plurality of transverse bores. To accomplish the changes of the pouring position of the melted metal with respect to the free surface of the body of the bath, the axis of the transverse bore is inclined with respect to a radial line of a ladle defining the bath of the melted metal. By this arrangement, the flow of the melted metal poured out of the transverse bore has come to have a momental component which causes a vortical movement of the bath, whereby there is caused a relatively rotating movement between the columnar member and the bath and the pouring position of the melted metal is constantly changed with respect to the free surface of the body of the bath. As modifications, the columnar member, or the ladle itself may be rotated around its axis by an external power. Instead of relatively rotating the pouring flow of the melted metal with respect to the body of the bath of melted metal, the pouring flow of the melted metal may be moved with respect to the body of the path in a zig-zag or other complicated manner so that the pouring position covers all regions of the free surface of the bath of the melted metal.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts throughout the several figures, and wherein:

FIGS. 9 to 12 are illustrations to explain the performances of apparatus constructed according to this invention.

DESCRIPTION OF THE PREFERRED EMBODIMENTS

Figure 1:
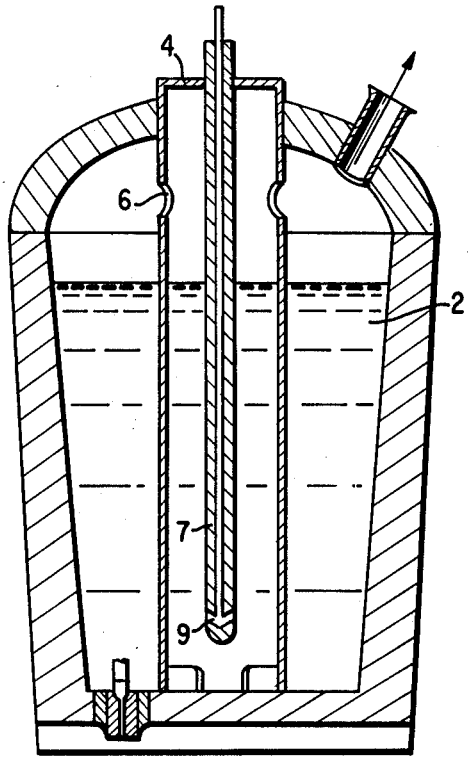
FIG. 1 (PRIOR ART)
FIG. 1 is a vertical section of a ladle showing a conventional prior art method of agitating a bath of melted metal.
Figure 2:
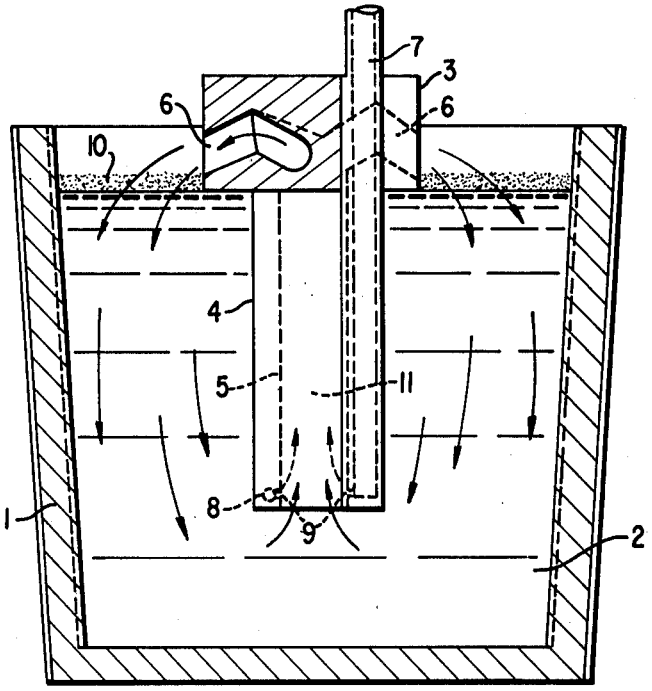
FIG. 2 is an elevational view of an embodiment of the apparatus according to this invention, partly in section, showing the manner of performing agitation according to this invention.
Figure 3:
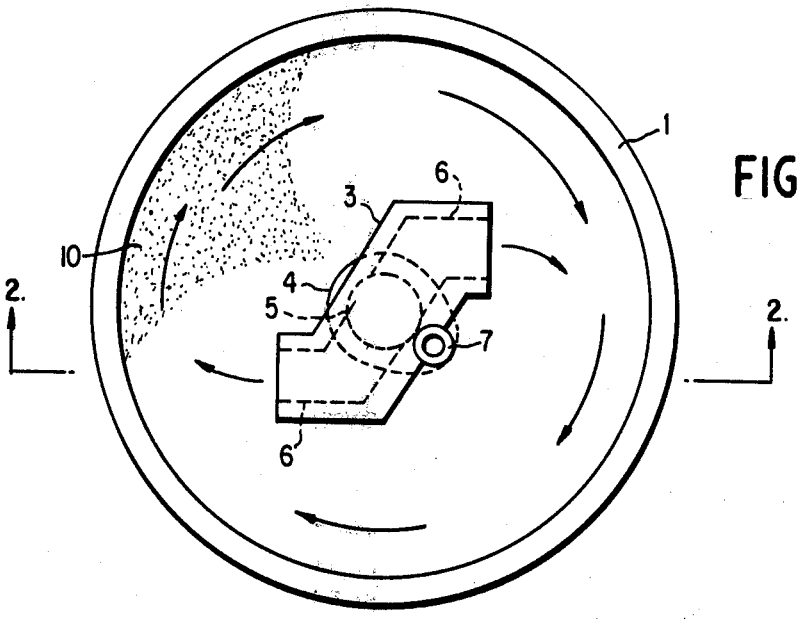
FIG. 3 is a plan view of the apparatus shown in FIG. 2.

Referring now to the drawings, and first to FIGS. 2 and 3 thereof, a ladle 1 is shown containing a bath 2 of a melted metal, in which there is disposed substantially vertical relation and substantially along the axis of the ladle 1 in agitating apparatus formed according to this invention and being generally designated by the reference numeral 3. The agitating apparatus 3 comprises a columnar member 4 having an axial bore 5 extending therethrough two radial bores 6a and two substantially transverse bores 6. The axial bore 5 is open at the lower end of the columnar member 4 and is in communication with the inner ends of the two radial bores and the two transverse bores 6 at the upper end thereof which are oriented transverse to the axis of the radial bores, the outer ends of the transverse bores being open in a manner to form nozzle means adapted to pour melted metal as will be described below. The columnar member 4 is further provided with a vertical gas passage 7 which is in communication at the lower end thereof with an annular channel 8, which in turn opens to the lower end portion of the bore 5 by way of a plurality of small radial openings 9.

In operation, when a compressed gas selected according to the purpose of giving agitation to the metal bath, so as to be, for example, unreactive with the metal or the treating agent provided as a floating layer 10, is supplied through the gas passage 7 to be blown out through the nozzles 9 into the bottom end portion of the bore 5, the gas forms a number of small bubbles which rise through a columnar body of the melted metal 11 confined in the axial bore 5. As the gas bubbles are mixed into the columnar body 11, the apparent specific gravity thereof is reduced as compared with that of the remaining body of the bath 2 whereby a lifting force is applied to the columnar body 11 due to an unbalance of the hydrostatic pressures at the bottom end portion of the columnar body 11. Since the floating-up velocity of the bubbles in the melted metal is relatively low, or the bending up time of the bubbles is relatively long, the columnar body 11 containing the gas bubbles and having a reduced apparent specific gravity is then lifted upward together with the bubbles so far that it flows into the radial bores and the transverse bores 6 and then flows down through inclined portions of transverse bore 6 in a manner of being poured onto the layer 10 of the treating agent. This lifting process is continuously effected by supplying the gas continuously through the gas passage 7 so that the columnar body 11 confined in the axial bore 5 is constantly substantially filled with gas bubbles. The gas contained in the melted metal in the form of the bubbles is released from the melted metal when the melted metal containing the gas bubbles is poured onto the layer 10 or the free surface of the bath 2 in a manner of splashing, thereby generating a highly agitated condition therearound. As the columnar body 11 rises through the axial bore 5, the melted metal residing around the bottom end portion of the axial bore 5 is introduced into the axial bore 5 to compensate the space to be left by the rising columnar body, and thus, a circulating flow of the melted metal as shown by the arrows in FIG. 2 is generated. Since in this case the circulating flow of the melted metal penetrates the layer 10 of the treating agent as well as the free surface of the bath of melted metal in the form of a poured and splashing flow, there are obtained advantageous effects of highly agitating the layer 10 of the treating agent to provide improved contacting and mixing between the melted metal and the treating agent and of effectively releasing the gases contained in the melted metal in the form of bubbles, whereby the gas mixed into the melted metal in the axial bore 5 is kept from being introduced into the remaining portion of the bath by accompanying the returning flow of the melted metal to unfavorably reduce the difference of the specific gravity of the bath inside and outside of the axial bore 5, and correspondingly reduce the circulation force.

As seen in FIG. 3, the axis of the transverse bore 6 is arranged to have an inclination with respect to a radial line of the ladle 1 so that the flow of the melted metal pouring out of the transverse bore 6 has a momental component in its momentum which will cause a rotating flow of the bath around the axis of the ladle 1. Thus, as the operation is continued, the flow of the melted metal exhausted out of the transverse bore 6 is being continuously poured onto different portions of the treating agent layer 10, whereby the agitating effect is very much improved.

Figure 4:
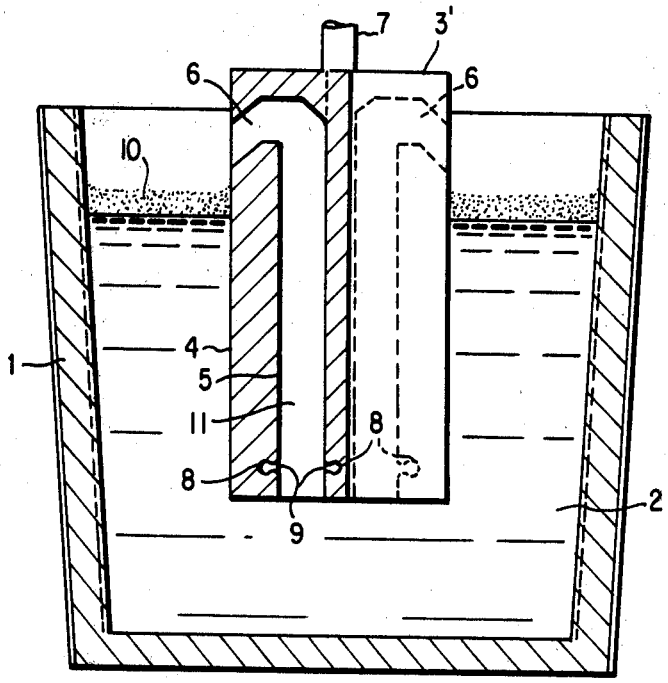
FIG. 4 is a view similar to that shown in FIG. 2, showing another embodiment of this invention.
Figure 5:
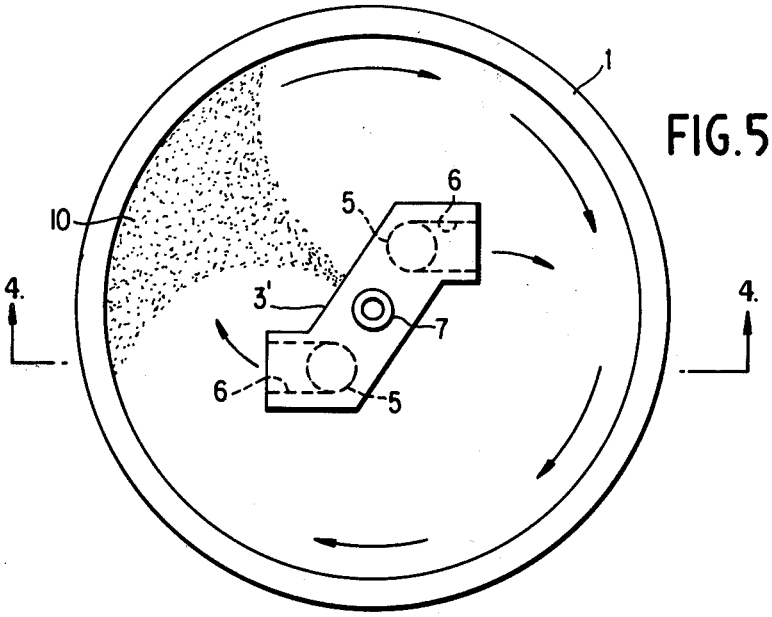
FIG. 5 is a plan view of the apparatus shown in FIG. 4.

FIGS. 4 and 5 show another embodiment of the apparatus according to this invention, wherein the apparatus generally shown by the reference numeral 3' is formed with two axial bores 5 arranged in parallel relation with each leading to only one transverse bore 6 for each axial bore. It will be understood that the apparatus shown in FIGS. 4 and 5 operates substantially in the same manner as that shown in FIGS. 2 and 3.

Figure 6:
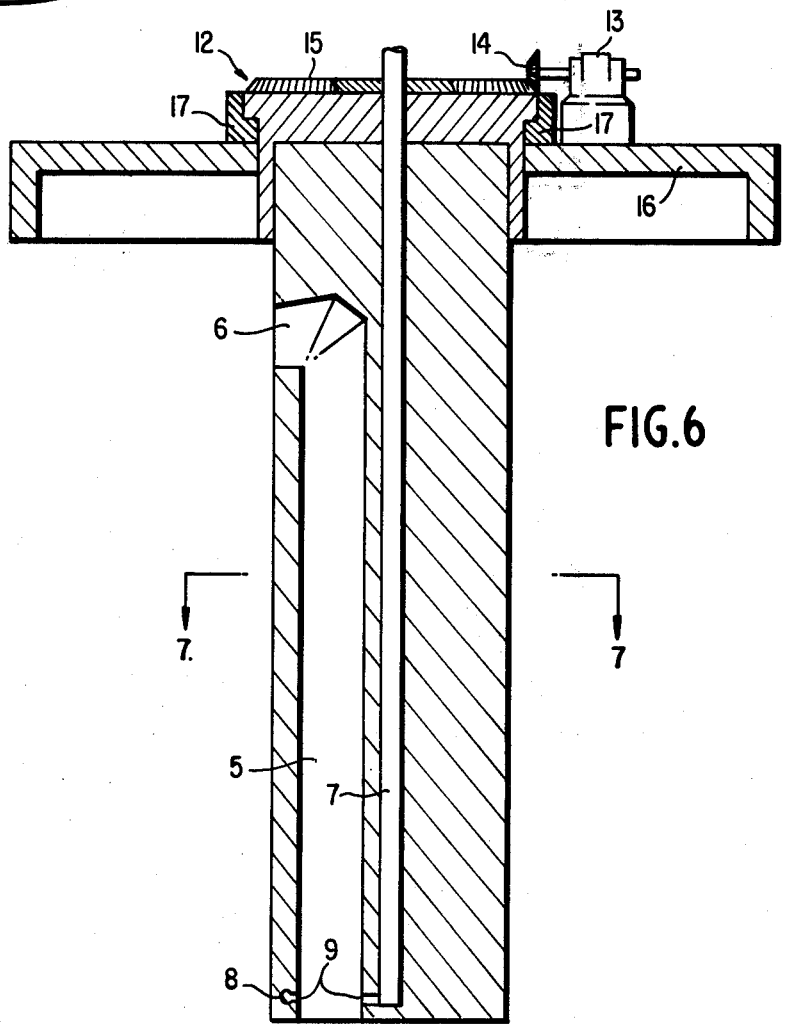
FIG. 6 is a vertical section of still another embodiment of the apparatus according to this invention.
Figure 7:
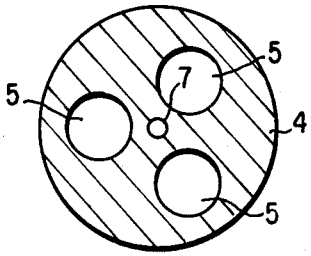
FIG. 7 is a sectional view taken along line VII—VII of FIG. 6.

FIGS. 6 and 7 show still another embodiment of the apparatus according to this invention, which is particularly adapted to be rotated around its axis by an external power means. In this case, the agitating apparatus generally designated by the reference numeral 12 includes a columnar member 4 formed with three axial bores 5 adapted to operate in the same manner as those shown in the preceding embodiments. However, in this case, the transverse bore 6 is made relatively short and to provide no momental driving force to the bath by the flow of the melted metal being poured therefrom. As a compensation therefor, this apparatus is equipped with externally powered driving means including a motor 13 and bevel gears 14 and 15. The columnar member 4 is rotatably carried by a frame 16, which is actually a cover adapted to fit the periphery of a ladle, by way of a bearing 17. The bevel gear 15 is firmly connected with the columnar member 4 and meshes with the bevel gear 14 carried by a shaft of the motor 13. The motor 13 is mounted on the frame 16. With this arrangement, it will be apparent that when the motor 13 is powered during the operation of the columnar member 4 in the same manner as described with reference to the preceding embodiments, the flow of melted metal exhausted from the transverse bore 6 is continuously poured onto different portions of the layer 10 of the treating agent floated on the free surface of the bath 2 of the melted metal.

Figure 8:
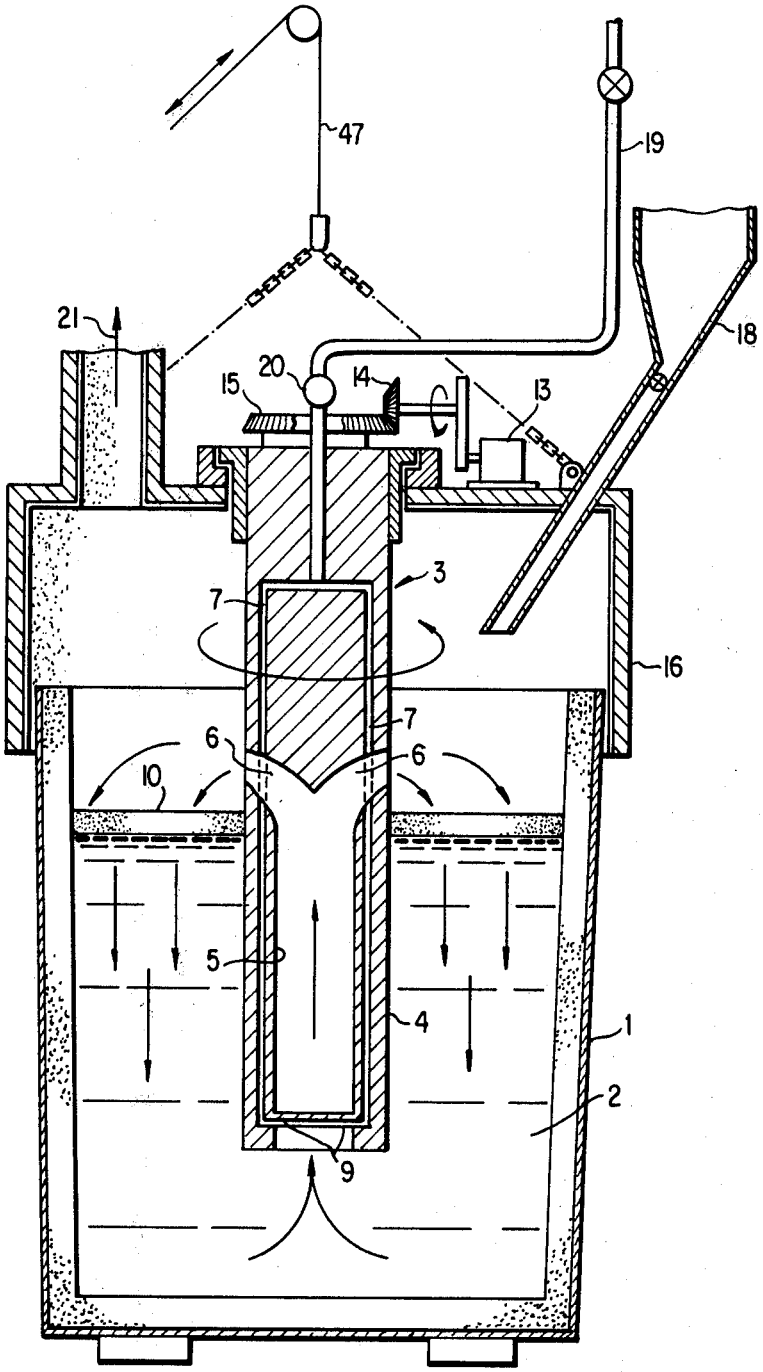
FIG. 8 is a schematic vertical section of a melted metal treating equipment incorporating apparatus according to this invention.

FIG. 8 shows relatively detailed structures of a melted metal treating equipment incorporating an embodiment of the agitating apparatus according to this invention, the apparatus therein incorporated being of a power-driven type similar to that shown in FIGS. 6 and 7. As shown in FIG. 8, in more detail, the agitating apparatus 3 is mounted to the cover 16 and is suspended by way of the cover 16 by proper suspension means 47, such as wire and chains. The cover 16 is further provided with a chute 18 for introducing a treating agent to form the layer 10 thereof floated to the free surface of the bath of the melted metal 2. A gas pipe 19 supplies the gas to be blown out through the openings 9 and is connected with an annular gas passage 7 by way of a rotatable joint 20 to allow rotation of the columnar member 4 around its axis. The gas mixed into the melted metal and released therefrom when the flow of melted metal containing the bubbles of the gas is poured out of the transverse bores 6 and splashes against the layer 10 of the treating agent gathers in the space defined by the cover 16 above the free surface of the bath 2 of the melted metal and is led out through an exhaust pipe 21 to be exhausted or be reused, according to the conditions.

The inventors have carried out various kinds of research and experiments and have confirmed that the apparatus as shown in FIG. 8 operates satisfactory to treat a bath of melted metal of the order of 200 tons in spite of its simple structure having only one axial bore. Although it is though to be preferable in view of the simplicity of structure to employ only one axial bore, it also may be thought to be more preferable to use a plurality of axial bores such as 2 to 5 parallel axial bores in view of improving the performance of the agitating apparatus or in order to be favorably adapted to particular shapes of ladles, and the like. However, as a result of research and experiments with an agitating apparatus having three axial bores, it has been confirmed that the performance of the apparatus having three axial bores is substantially the same as that of the apparatus having only one axial bore, such as shown in FIG. 8. In this connection, it has also been confirmed that the number of the transverse bores 6 connected with the one axial bore 5 has no substantial effect on the amount of circulation of the melted metal in case of the agitating apparatus shown in FIG. 8 where the length of the transverse bore is relatively short, so long as the fluid-dynamical resistance exerted in the vertical bore is the same. However, in view of effectively utilizing all portions of the treating agent provided as the layer 10 floating on the free surface of the bath 2 of the melted metal and of shortening the time required for the treatment of the melted metal it is favorable to have the flow of the melted metal poured at as many positions possible over the entire free surface of the bath of melted metal, and from this point of view, it is favorable to employ a plurality of transverse bores in connection with the one axial bore. The agitating apparatuses as shown in FIGS. 2–5, which generate relative rotation between the columnar member 4 and the bath 2 of melted metal due to the reaction of the flow of the melted metal pouring out of the transverse bores, are favorably used in treating apparatuses of small or medium sizes. In this case, the inclination of the transverse bore 6 with respect to a radial line of the columnar member 4 or the ladle 1 is preferably selected to be in a range of 10–60 degrees. However, in case of a large sized treating apparatus, such as treating a bath of melted metal or more than 100–200 tons, the relative rotation between the agitating apparatus and the bath of melted metal generated by the reaction force of the flow of the melted metal poured out of the transverse bores is not enough to obtain a good treatment of the melted metal due to a high resistance caused by the viscosity and friction of the melted metal and the treating agent, and therefore, in the large sized treating apparatus, it is favorable that the relative rotation be effected by an external power in the manner as shown in FIGS. 6–8. The speed of the relative rotation may be of the order of several rotations per minute (rpm), which low speed of relative rotation may be effected, even in a large sized treating apparatus, by a small power such as 1 horse power.

Figure 9:
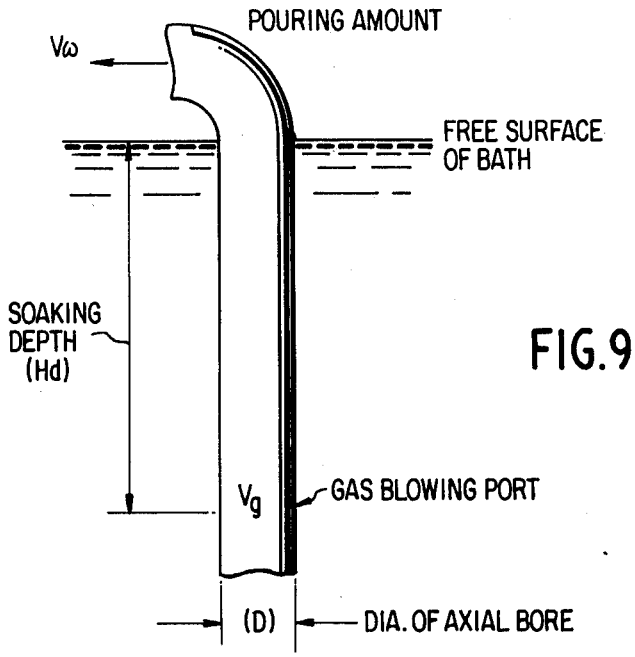

Since, in this invention, the circulation of the melted metal is dependent upon a difference of hydrostatic pressure due to a difference of apparent specific gravities of the inside and outside of the columnar member 4, the circulation and accordingly the performance of agitation depends substantially upon the dimensional conditions of the columnar member 4, especially the axial bore 5 thereof and the condition of blowing gas therein. Relations among these factors have been experimentally studied and are illustrated in FIGS. 9–11.

Figure 10:
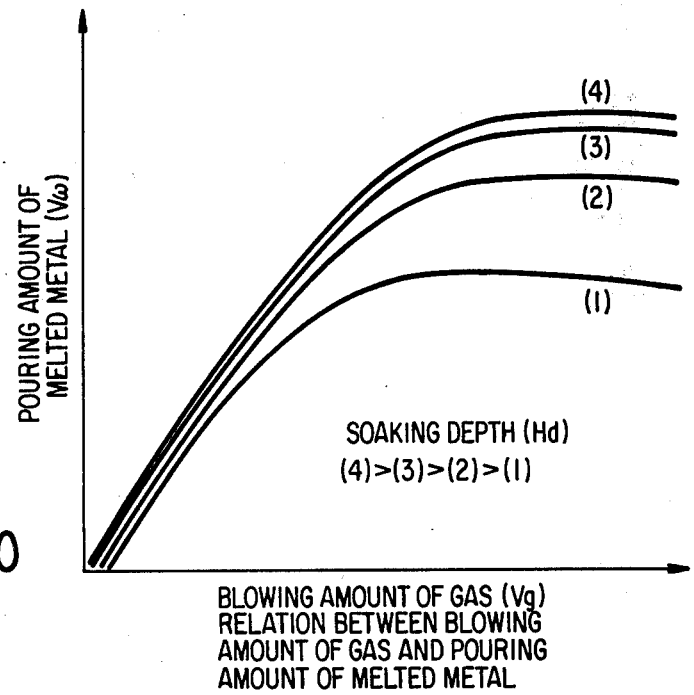

When the amount Vg of blowing gas is gradually increased with a constant diameter D axial bore and soaking depth Hd, the pouring amount Vw of the melted metal increases first in proportion to the amount of blowing gas, and as the amount of blowing gas is further increased, the increase of the amount of melted metal being poured gradually saturates as shown in FIG. 10. This is due to the fact that since there is an upper limit for the gas bubbles being independently held in a liquid phase of the melted metal to effectively reduce the apparent specific gravity thereof, if the amount of gas being blown is beyond the upper limit, the gas bubbles being to join with each other by overcoming the surface tension of the melted metal, thus causing a blowing-through phenomenon of the gas in the vertical bore. If the blowing-through phenomenon happens more vigorously due to increasing the amount of blowing gas the amount of the melted metal being poured is decreased rather than a balanced upper limit being reached as the amount of blowing gas is increased. By increasing the soaking depth of the columnar member, the point at which the pouring amount of the melted metal reaches the balanced upper limits is shifted to a region of a larger amount of blowing gas as shown in FIG. 10 and the absolute value of the balanced upper limit is of course accordingly increased. To increase the diameter of the axial bore has the same effect as increasing the soaking depth of the axial bore with respect to the ratio of the volume occupied by the gas in the vertical bore, and therefore, the effect of blowing gas is shifted to a more favorable region. However, since the amount of the melted metal to be raised or circulated increases in proportion to the cross-sectional area of the actual bore is not increased, but rather reduced. Therefore, in order to obtain the same level of rising as in an axial bore having a smaller diameter, the soaking depth of the columnar member must be increased.

FIG. 11 shows an example of the relation among the diameter D of the axial bore, soaking depth Hd and pouring amount Vw of the melted metal. As seen from FIG. 11, it can happen that the pouring amount Vw becomes larger with an axial bore having a smaller diameter in a region of small soaking depth. As a result of the experiments, the inventors have confirmed that the ratio of the diameter D of the axial bore to the soaking depth Hd should be smaller than $\frac{1}{3}$ ($D/Hd < \frac{1}{3}$).

Table 1 shows several examples of the results of a desulphurizing treatment of melted pig iron performed by employing the apparatus according to this invention. The treating apparatus had substantially the same structure as shown in FIG. 8, including a columnar member having one axial bore and rotated by an external power drive. The dimensional and operational conditions of the apparatus are given in Table 1. Nitrogen ($N_2$) was used as the gas to be blown in and the nozzles for blowing the gas were positioned 100 mm above the lower end of the axial bore to avoid escaping of the gas by the turning of the lower end portion of the columnar member.

In Table 1, as a result of treatment by a conventional method by repeated pouring from one ladle to the other in desulphurizing treatment of melted pig iron is parallelly given for the purpose of comparison.

TABLE 1

COMPARISON OF TREATMENTS ACCORDING TO THIS INVENTION AND A CONVENTIONAL LADLE CHANGING METHOD IN DESULPHURIZING

| | | | Treatments Conducted According To the Present Invention | | | | | Conventional Treatment |
|---|---|---|---|---|---|---|---|---|
| | | | 1 | 2 | 3 | 4 | 5 | |
| Particulars of Equipment | Number of axial bores | | 3 | 3 | 1 | 1 | 1 | — |
| | Diameter of axial bore (mm) | | 150 | 150 | 600 | 600 | 600 | — |
| | Length of axial bore (mm) | | 1,250 | 1,250 | 2,600 | 2,600 | 2,600 | — |
| | Number of transverse bores | | 3 | 3 | 4 | 4 | 4 | — |
| | Rotational speed (rpm) | | 4 | 0 | 5.5 | 5.5 | 5.5 | — |
| | Treating amount of melted pig iron (ton) | | 5.2 | 4.9 | 204 | 194 | 187 | 200 |
| | Desulphurizer | | $C_aC_2$ | $C_aC_2$ | $C_aC_2$ | $C_aC_2$ | $C_aC_2$ | $NA_2CO_3$ |
| | Amount of desulphurizer (Kg/ton pig.) | | 19 | 10 | 4.9 | 5.2 | 5.4 | 7.0 |
| | Gas blown in | | $N_2$ | $N_2$ | $N_2$ | $N_2$ | $N_2$ | — |
| | Amount of gas blown in ($Nm^3$/min.) | | 0.7 | 0.7 | 10.8 | 12.5 | 10.0 | — |
| | Circulation rate of melted pig iron (ton/min.) | | 2.0 | 2.0 | 110 | 117 | 104 | — |
| | Treating time (min.) | | 16.5 | 18 | 12 | 12 | 17 | 10 |
| | Temperature of melted pig iron (°C.) | Before treatment | 1,400 | 1,390 | 1,330 | 1,315 | 1,310 | 1,340 |
| | | After treatment | 1,345 | 1,340 | 1,313 | 1,300 | 1,290 | 1,320 |
| Composition of melted Pig iron (%) | Before Treatment | C | 4.43 | 4.45 | 4.52 | 4.50 | — | 4.50 |
| | | Si | 0.36 | 0.37 | 0.48 | 0.45 | 0.51 | 0.50 |
| | | S | 0.061 | 0.056 | 0.033 | 0.025 | 0.056 | 0.045 |
| | | N | — | — | 0.0043 | 0.0040 | — | — |
| | After | C | 4.45 | 4.45 | 4.52 | 4.48 | — | 4.45 |
| | | Si | 0.39 | 0.40 | 0.47 | 0.44 | 0.48 | 0.37 |

TABLE 1-continued

COMPARISON OF TREATMENTS ACCORDING TO THIS INVENTION AND A CONVENTIONAL LADLE CHANGING METHOD IN DESULPHURIZING

| | | Treatments Conducted According To the Present Invention | | | | | Conventional |
|---|---|---|---|---|---|---|---|
| | | 1 | 2 | 3 | 4 | 5 | Treatment |
| Treatment | S | 0.003 | 0.004 | 0.003 | 0.004 | 0.004 | 0.015 |
| | N | — | — | 0.0039 | 0.0042 | — | — |
| Extent of desulphurization (%) | | 95 | 93 | 91 | 84 | 93 | 87 |

FIG. 12 shows the relation between the sulphur content and the treating time in a desulphuring treatment of melted pig iron.

The method and apparatus according to this invention can be applied not only to desulphuring treatment but also to dephosphorizing, desilifying or degasifying, as well as alloying or adjusting of components of the melted metal.

Obviously, many modifications and variations of this invention are possible in light of these teachings. It is to be understood therefore that within the scope of the appended claims, the present invention may be practiced otherwise than as specifically described herein.

What is claimed as new and desired to be secured by Letters Patent of the United States is:

1. An apparatus for agitating a bath of melted metal for treating the same, comprising a columnar member adapted to be substantially vertically arranged in said bath and having at least one axial bore extending therethrough and at least one transverse bore;

said axial bore opening at the lower end thereof into said bath and communicating with said transverse bore at the upper end thereof;

said columnar member being further provided with a gas passage opening to the inside of said axial bore at a portion adjacent the lower end thereof; and the axis of said transverse bore being inclined with respect to a radial line of said columnar member.

2. An apparatus according to claim 1, wherein said columnar member is freely rotatable about its central axis from which said radial line extends.

3. An apparatus for agitating a bath of melted metal for treating the same, comprising a columnar member adapted to be substantially vertically disposed in said bath and having at least one axial bore extending therethrough and at least one transverse bore;

said axial bore opening at the lower end thereof into said bath when disposed therein and communicating with said transverse bore at the upper end thereof;

said columnar member being further provided with a gas passage opening to the inside of said axial bore at a portion adjacent the lower end thereof; and external drive means for rotating said columnar member about its central axis.

4. An apparatus according to claim 3, wherein the ratio of the diameter of said axial bore to the soaking depth of said axial bore in said bath when said columnar member is disposed in said bath is smaller than $\frac{1}{3}$.

5. An apparatus for agitating a bath of melted metal having a layer of a treating agent floating thereon, comprising:

a columnar member vertically disposed in said bath having at least one axial bore extending therethrough for permitting said melted metal to rise therein, and having at least one axial transverse bore in the upper end thereof opening said axial bore to the region above the surface of said bath of melted metal in the operative state;

means for blowing a gas substantially radially into said axial bore near the bottom of said columnar member for causing said melted metal therein to have a reduced apparent specific gravity and to bubble up through said columnar member; and means for rotating said columnar member in said bath of melted metal about a vertical axis, whereby said at least one transverse bore moves continuously in a circle to pour said melted metal from said columnar member onto said surface of said bath at continuously changing positions.

6. An apparatus for agitating a bath of melted metal for treating the same, comprising:

a one-piece columnar member adapted to be substantially vertically arranged in said bath and having at least one axial bore extending therethrough along substantially the entire length of said columnar member, at least one radial bore connected to said axial bore and at least one transverse bore connected to said radial bore;

said axial bore opening at the lower end of said columnar member into said bath and communicating with said radial bore at the upper end of said radial bore;

gas passage means opening to said axial bore at a portion adjacent the lower end thereof and a lower end of said columnar member admitting gas thereinto to thereby reduce the apparent specific gravity of said melted metal and for causing the same to rise vertically upwardly within said axial bore and be discharged from said transverse bore;

the axis of said transverse bore being vertically inclined and offset in a horizontal plane with respect to a radial line of said one-piece columnar member and disposed above said bath so as to discharge said melted metal onto the surface of said bath;

means for rotating said one-piece columnar member at a predetermined rate of speed so as to cause the discharge of said melted metal from said transverse bore to continuously impinge upon different portions of said bath and create a vortical movement of said bath; and means for feeding gas to said gas passage connected to said columnar member.

7. An apparatus according to claim 6, wherein said columnar member is freely rotatable about its central axis from which said radial line extends.

8. An apparatus for agitating a bath of melted metal for treating the same, comprising:

a one-piece columnar member adapted to be substantially vertically disposed in said bath and having a first and second parallel axial bore extending therethrough along substantially the entire length of said columnar member and at least a first and second transverse bore disposed above said bath and connected to said first and second axial bore, respectively;

said first and second axial bore opening at the lower end of said columnar member into said bath when disposed therein and communicating with said first and second transverse bore respectively at the upper end of said first and second axial bore;

gas passage means opening to said first and second axial bore at a portion adjacent the lower ends thereof and a lower end of said columnar member for admitting gas thereinto to thereby reduce the apparent specific gravity of said melted metal and for causing the same to rise vertically upwardly within said first and second axial bore and be discharged from said first and second transverse bore;

external drive means for rotating said one-piece columnar member about its central axis at a predetermined rate of speed so as to cause the discharge of said melted metal from said first and second transverse bore to continuously impinge upon different portions of said bath and create a vortical movement of said bath; and means for feeding gas to said gas passage connected to said columnar member.

9. An apparatus according to claim 8, wherein the ratio of the diameter of said axial bore to the soaking depth of said axial bore in said bath when said columnar member is disposed in said bath is smaller than $\frac{1}{3}$.

10. An apparatus according to claim 8, wherein the axis of said first and second transverse bore is vertically inclined and offset in a horizontal plane with respect to a radial line of said one-piece columnar member and disposed above said bath so as to discharge said melted metal onto the surface of said bath.

* * * * *